United States Patent [19]

Asenbauer

[11] Patent Number: 4,572,371

[45] Date of Patent: Feb. 25, 1986

[54] PLASTIC HOLDING TRAY FOR LIQUID SAMPLE TUBES

[76] Inventor: Donald J. Asenbauer, 29933 Louis Ave., Canyon Country, Calif. 91351

[21] Appl. No.: 629,958

[22] Filed: Jul. 11, 1984

[51] Int. Cl.[4] ..... B65D 85/20; B65D 21/00

[52] U.S. Cl. ..... 206/443; 206/480; 206/459; 206/560; 206/564; 206/518

[58] Field of Search ..... 206/63.3, 443, 820, 206/480, 558, 561, 564, 365, 508, 518

[56] References Cited

U.S. PATENT DOCUMENTS

| | | | |
|---|---|---|---|
| 2,598,492 | 5/1952 | Boes | 206/480 |
| 2,720,969 | 10/1955 | Kendall | 206/365 |
| 2,883,061 | 4/1959 | Moore | 206/480 |
| 3,270,877 | 9/1966 | Hecker | 206/564 |
| 3,272,371 | 9/1966 | Weiner | 206/443 |
| 3,335,847 | 8/1967 | Murphy et al. | 206/558 |
| 3,606,006 | 9/1971 | Raybois | 206/561 |
| 3,707,227 | 12/1972 | Britt | 206/443 |
| 4,151,913 | 5/1979 | Freitag | 206/63.3 |
| 4,392,389 | 7/1983 | Eckstein et al. | 206/820 |

FOREIGN PATENT DOCUMENTS

| | | | |
|---|---|---|---|
| 972302 | 8/1975 | Canada | 206/443 |
| 2359041 | 5/1975 | Fed. Rep. of Germany | 206/443 |

*Primary Examiner*—Joseph Man-Fu Moy

[57] ABSTRACT

A sample organizer that will retain a number of fluid samples such as blood samples, for example, wherein each such sample is contained in an individual plastic collection tube. The plastic collection tubes fit into horizontally defined apertures which allow the tubes to be inserted without undue force. The apertures are specifically designed to allow secure insertion and retention of blood samples, for example, without promoting hemolysis. The fluted carriage design also prevents the sample collection tubes from spontaneous dislodgment. Sample organizers may be "stacked" or nested due to the lightweight frame design and further, provide for fluid sample identification such as number, name, source, verification, etc.

1 Claim, 8 Drawing Figures

PLASTIC HOLDING TRAY FOR LIQUID SAMPLE TUBES

FIELD OF THE INVENTION

This invention relates generally to a stackable container for fluid samples and more particularly to the organization, retention and identification of fluid samples contained in individual plastic collection tubes in or on such a stackable or nestable container.

DESCRIPTION OF THE PRIOR ART

Figure 1:
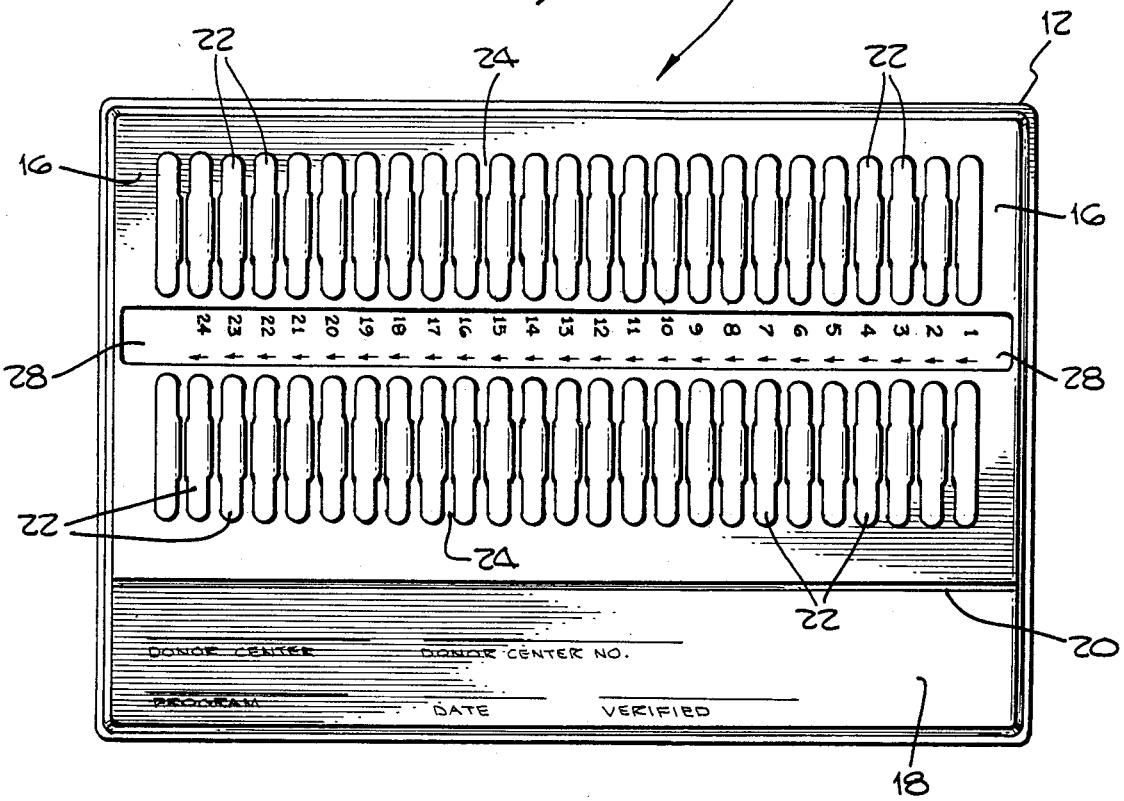
FIG. 1 is a plan view of the fluid sample organizer.

Fluid sample organizers are known in which fluid samples may be retained and identified, however, many of these prior art devices are position sensitive so that the fluid may be spilled from the individual collection tubes. In transporting some of these prior art devices, identification indicia have been confused both with respect to individual samples and with respect to sample source. Many of the sample organizers have been bulky, fragile and difficult to transport and/or store. In many of the prior art devices, breakage, both of the sample organizers and of the sample collection tubes, has presented an unacceptable problem.

It would thus be a great advantage to the art to provide a fluid sample organizer that will provide for reliable identification of both sample and sample source.

It would be a further advantage to provide the above fluid sample organizer in a form that would permit easy transportation and storage.

A further great advantage would be realized by the provision of a fluid sample organizer that permits easy retentive placement and removal of individual sample collection tubes.

Yet another great advantage would be the provision of the above advantages in a device that, while both strong and reliable, is economical and simple to manufacture.

SUMMARY OF THE INVENTION

The sample organizer of the present invention, while sturdy and break-resistant, is easy to manufacture by well-known methods. Fluid samples, in their individual plastic collection tubes, once inserted into position, are unlikely to become spontaneously dislodged. While both insertion and detachment of sample tubes may be accomplished with ease, it is highly unlikely that either will be accomplished accidentally.

It is, therefore, an object of the present invention to provide a sample organizer for fluid samples.

It is also an object of the present invention to provide the above sample organizer in a form that will retain identification of the samples so organized.

It is a further object of the present invention to provide a device for organizing samples that will retain a number of individual fluid samples of common origin in a single sample retaining device.

A still further object of this invention is to provide a simple means of transporting and/or storing a great many of the above-mentioned fluid samples.

Still another object of the present invention is to provide the above-mentioned sample organizer in a form that is simple and economical to manufacture by known means of fabrication.

DETAILED DESCRIPTION

Although a specific embodiment of the invention will now be described with reference to the drawings, it should be understood that the embodiment is by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 2:
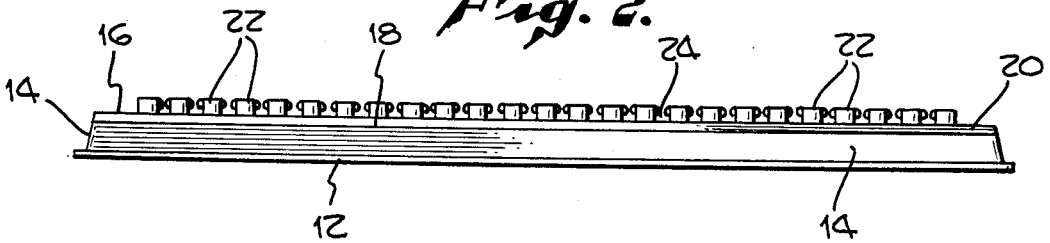
FIG. 2 is a lengthwise side elevation of the fluid sample organizer.
Figure 3:
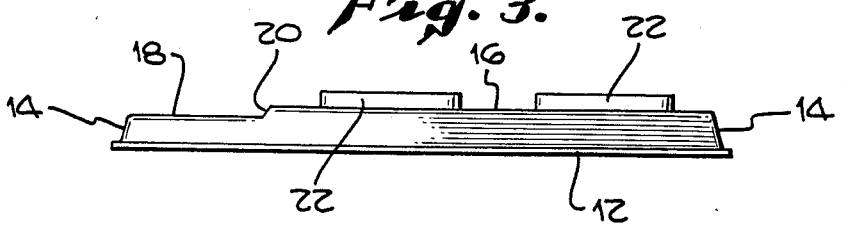
FIG. 3 is an end side elevation of the fluid sample organizer.

Referring to FIGS. 1, 2, and 3 with greater particularity, the stackable or nestable fluid sample organizer is denoted generally by the numeral 10. It is contemplated that the fluid sample organizer is integrally formed from a single piece of material. While the invention specifically contemplates the use of plastic material for its fabrication, its application nevertheless, is not to be thus limited.

Figure 8:
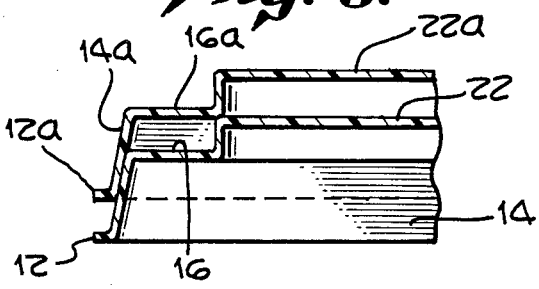
FIG. 8 is a partial cross sectional view showing how two or more of the sample organizers may be stacked or nested together.

A slightly outward slope of the stacking step 14 is provided all around the periphery of the device and peripherally enclosing it whereby an upper sample organizer can be stacked or nested upon a lower one by fitting the upper portion of the lower organizer into the space provided by the stacking step 14. As best seen in the enlargement of FIG. 8, an organizer designated by an a added to its identifying numeral is stacked or nested upon a lower container. The peripheral ledge 12 is shown at the bottom of the stacked configuration with the peripheral ledge 12*a*, a distance above as determined by the slope of the stacking steps 14 and 14*a*. Sample planes 16 and 16*a* are shown in relation to each other wherein the dimension that 16*a* occupies above 16 is determined as shown by the dimension of flat topped sample retaining promontory 22, shown the same distance below sample retaining promontory 22*a*.

In FIG. 1, it will be noted that the flat topped sample retaining promontories 22 are formed in side-to-side neighboring pair relationship in two columns having pair wise symmetry between columns upon sample plane 16. Between the sides of each two interiorly placed sample retaining promontories 22, there is also defined a sample retaining space 24. Each sample promontory is fabricated so as to have a flat top portion and two longitudinally extending, laterally projecting lips 30, FIGS. 4, 5 and 7 one on each lengthwise side, except for the exterior promontories of each column, each of which has only one such lip, oriented interiorly toward the adjacent promontory.

Contained within and coplanar to the sample plane 16 is numeral plane 28, so named because it includes ordered numerals as shown for the purpose of identifying individual sample tubes retained in the sample retaining spaces 24 as will be further explained.

The sample plane 16 is bounded by a lengthwise step 20 that extends from the stacking or nesting step 14 at one end of the organizer to the stacking or nesting step 14 at the other end. The lengthwise step 20 thus separates the sample plane 16 from the identification plane 18. As apparent from examination of FIG. 1, the identification plane 18 serves to provide for the identification of a particular stackable or nestable fluid sample organizer. Exemplary indicia are included thereon for purposes of example only and have no purpose to limit the invention thereby. Thus, identification indicia may be chosen generally to suit need of any application.

FIG. 2 shows an edgewise view of the device so that the fluted configuration of the flat topped promontories 22 may be more plainly evident and so that the constraints of the spaces 24 may be more clearly apparent.

FIG. 3 shows an end-on view with the peripheral ledge 12 and stacking or nesting step 14 in another perspective. The relation of lengthwise step 20 is shown in profile connection to identification plane 18 and sample plane 16.

Figure 4:
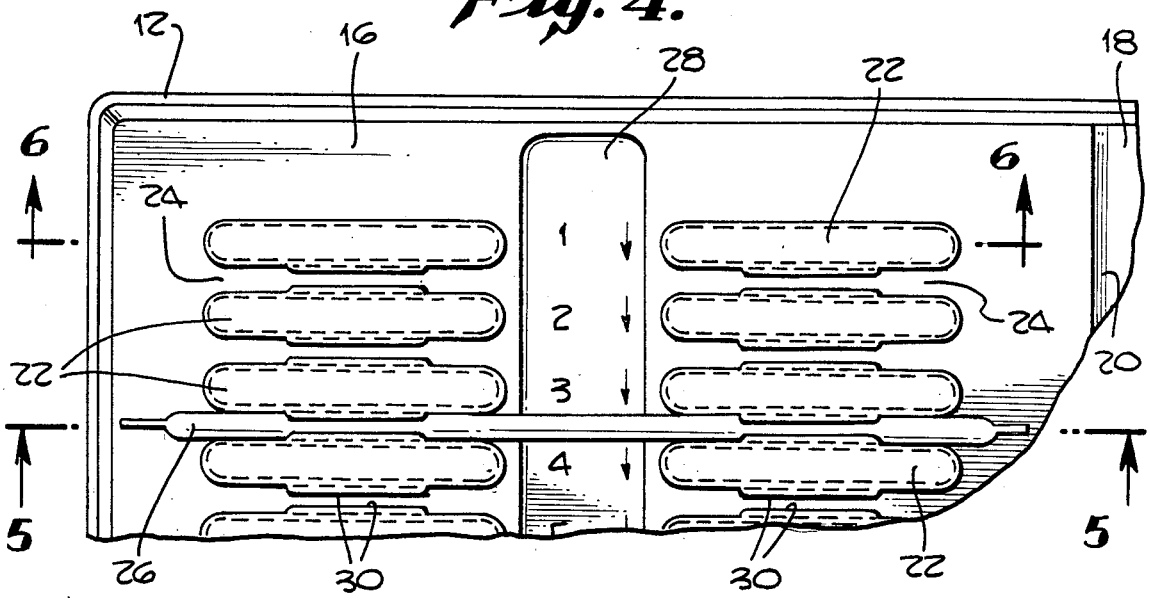
FIG. 4 is a partial plan view enlargement of the fluid sample organizer.

In FIG. 4, a sample tube 26 is shown inserted into a sample retaining space 24 between two flat topped sample retaining promontories 22 and frictionally constrained there by the cooperation of longitudinally extending lips 30. It should be clear that the numeral shown in numeral plane 28 provides ordinal identification of the fluid sample tube 26 immediately below such numeral.

Figure 5:
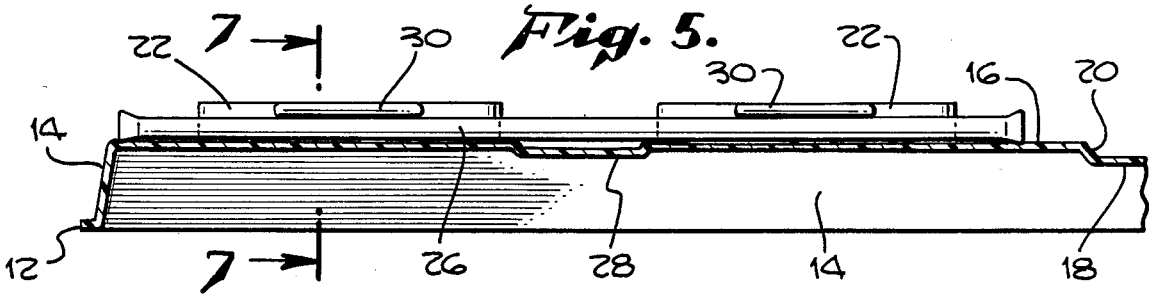
FIG. 5 is a cross sectional view taken along the sight lines 5—5 of FIG. 4.
Figure 6:
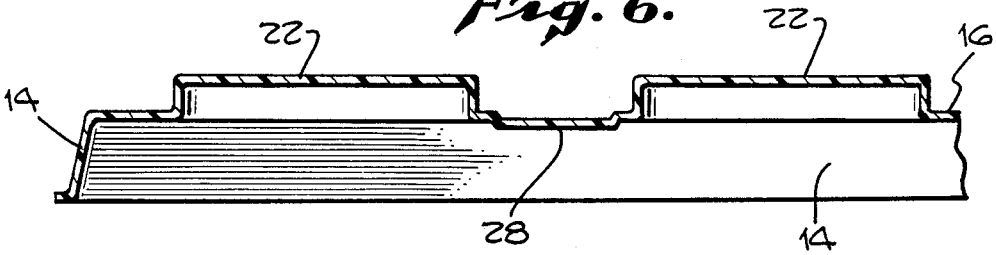
FIG. 6 is a cross sectional view taken along the sight lines 6—6 of FIG. 4.
Figure 7:
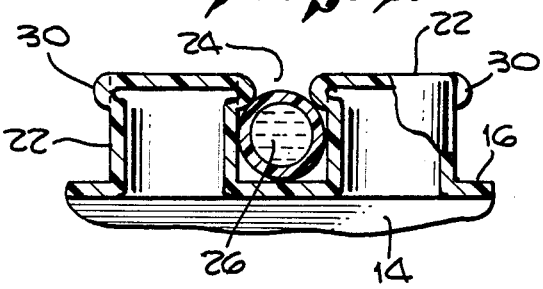
FIG. 7 is an enlargement of a view in partial cross section showing detail of the frictional sample retaining mechanism of the sample organizer, taken along the sight lines 7—7 of FIG. 5.

FIG. 5, as indicated by the sight lines 5—5 of FIG. 4, shows an endwise cross section wherein it may be seen that the plane 28, is sub-coplanar with sample plane 16. FIG. 6, as indicated by the sight lines 6—6 of FIG. 4, shows an endwise cross section wherein the individual plastic collection tube 26 is shown in its relation to one pair of the promontories in the different columns. FIG. 7 shows an enlarged cross section of the plastic tube 26 frictionally constrained in sample retaining space 24 by two adjacent sample retaining promontories 22 in the same column by their longitudinally extending, laterally projecting lips 30.

Thus, there has been described a stackable or nestable, fluid sample organizer that will provide for the identification of each nestable stackable organizer in a nested stack and further will provide for the identification of each individual plastic collection tube retained on each organizer. Great improvements in identification, reliability, transportability, ease of operation, safety and economy have been provided through the novel advantages of the invention.

It is here pointed out that although the present invention has been shown and described with reference to a particular embodiment, nevertheless various changes and modifications, obvious to one skilled in the art to which the invention pertains, are deemed to lie within the purview of the invention.

What is claimed and desired to be secured by Letters Patent of the United States is:

1. A stackable or nestable fluid sample organizer for organizing and releasably retaining individual fluid samples in individual plastic collection tubes, which comprises:

a member defining a sample plane;

at least two columns of sample retaining promontories having pairwise symmetry on said sample plane;

sample retaining spaces defined by each pair of pairwise symmetrical sample retaining promontories;

a member defining a numerical plane, coplanar with said sample plane and having ordered numerals thereon for identifying and thereby identifying each of said sample retaining spaces;

at least one longitudinally extending, laterally projecting lip on each of said sample retaining promontories for frictionally retaining sample tubes in said sample retaining spaces;

a member defining an identification plane, coplanar with said sample plane;

a lengthwise step separating said identification plane from said sample plane;

a stacking step peripherally enclosing said sample plane, said numeral plane and said identification plane; and a peripheral ledge forming a base for said stacking step.

* * * * *